US009558650B2

(12) United States Patent
Chou et al.

(10) Patent No.: US 9,558,650 B2
(45) Date of Patent: Jan. 31, 2017

(54) SURVEILLANCE METHOD, SURVEILLANCE APPARATUS, AND MARKING MODULE

(71) Applicant: AVer Information Inc., New Taipei (TW)

(72) Inventors: Yu-Chin Chou, New Taipei (TW); Wei-Hsiao Wang, New Taipei (TW); Hsin-Yen Lee, New Taipei (TW); Jui-Hsuan Chiang, New Taipei (TW); Tsung-Lin Lee, New Taipei (TW); Chih-Hsin Tsao, New Taipei (TW)

(73) Assignee: AVER INFORMATION INC., New Taipei (TW)

( * ) Notice: Subject to any disclaimer, the term of this patent is extended or adjusted under 35 U.S.C. 154(b) by 110 days.

(21) Appl. No.: 14/682,961

(22) Filed: Apr. 9, 2015

(65) Prior Publication Data

US 2016/0093204 A1 Mar. 31, 2016

(30) Foreign Application Priority Data

Sep. 26, 2014 (TW) ..... 103133647 A

(51) Int. Cl.

| | |
|---|---|
| ***G08B 23/00*** | (2006.01) |
| ***G08B 29/18*** | (2006.01) |
| ***G08B 13/196*** | (2006.01) |

(52) U.S. Cl.
CPC ..... *G08B 29/188* (2013.01); *G08B 13/19645* (2013.01)

(58) Field of Classification Search
CPC .. G08B 29/188; G08B 13/19645; G05B 15/02
See application file for complete search history.

(56) References Cited

U.S. PATENT DOCUMENTS

| | | | | |
|---|---|---|---|---|
| 6,104,295 | A * | 8/2000 | Gaisser | G06K 19/07749 340/572.8 |
| 2011/0084807 | A1* | 4/2011 | Logan | H04Q 9/00 340/10.1 |
| 2013/0338865 | A1* | 12/2013 | Kryze | B60L 11/1851 701/22 |

* cited by examiner

*Primary Examiner* — Tai Nguyen
(74) *Attorney, Agent, or Firm* — Locke Lord LLP; Tim Tingkang Xia, Esq.

(57) ABSTRACT

A surveillance method, a surveillance apparatus, and a marking module are applied to an active burglarproof system. The surveillance method includes the following steps. Determine whether a first wireless signal related to a marking module is received in a first sensing region, to produce a first determination result. Determine whether the first wireless signal is received in a second sensing region, to produce a second determination result. Selectively generate a warning signal according to the first determination result and the second determination result.

16 Claims, 11 Drawing Sheets

SURVEILLANCE METHOD, SURVEILLANCE APPARATUS, AND MARKING MODULE

CROSS-REFERENCE TO RELATED APPLICATIONS

This non-provisional application claims priority under 35 U.S.C. §119(a) on Patent Application No(s). 103133647 filed in Taiwan, R.O.C. on Sep. 26, 2014, the entire contents of which are hereby incorporated by reference.

TECHNICAL FIELD

The disclosure relates to a surveillance method and an apparatus thereof, more particularly to a surveillance method, a surveillance apparatus, and a marking module, which are applied to a burglarproof system.

BACKGROUND

A burglarproof system generally includes a network video recorder (NVR), an alarm bell, and/or an alarm light emitter. Image data is transmitted to video recording equipment after being captured by the network video recorder. The image capturing can performed by full time recording or time scheduling. The object detection can be performed by image moving detection and can be triggered by wired sensors.

However, burglarproof systems nowadays have the following problems. Monitored devices now can not actively notify the burglarproof systems. Alternately, the burglarproof systems cannot determine whether a moving device is a monitored device. As a result, alarms may falsely be triggered, and the occurrence of burglaries can not be forecasted. If a burglary has happened, people could only use video files to check suspects and when the burglary happened. Moreover, the application of active burglarproof systems in the art is limited by a narrow detection space (e.g. a housing space or a business space) such that the active burglarproof systems cannot be applied to wider detection space (e.g. a school or a square).

Therefore, it is required in the art to have an active burglarproof system capable of being applied to a wider detection space, determining objects to be monitored, and supporting an early-warning function and an active alarm function.

SUMMARY

According to one or more embodiments, the disclosure provides a surveillance method applied to an active burglarproof system. In one embodiment, the surveillance method includes the following steps. Determine whether a first wireless signal is received in a first sensing region, to generate a first determination result. The first wireless signal is related to a marking module. Determine whether the first wireless signal is received in a second sensing region, to generate a second determination result. Selectively generate a warning signal according to the first determination result and the second determination result.

According to one or more embodiments, the disclosure provides a surveillance apparatus applied to an active burglarproof system. In one embodiment, the surveillance apparatus includes a first sensing module, a second sensing module, and a processing module. The first sensing module includes a first wireless transceiver unit and a first processing unit. The first wireless transceiver unit receives a first wireless signal in a first sensing region, and the first wireless signal is related to a marking module. The first processing unit is electrically connected to the first wireless transceiver unit and determines whether the first wireless transceiver unit receives the first wireless signal, to selectively produce a first determination result. The second sensing module includes a second wireless transceiver unit and a second processing unit. The second wireless transceiver unit receives the first wireless signal in a second sensing region. The second processing unit is electrically connected to the second wireless transceiver unit and determines whether the second wireless transceiver unit receives the first wireless signal, to selectively generate a second determination result. The processing module communicates with the first sensing module and the second sensing module and selectively generates a warning signal according to the first determination result and the second determination result.

According to one or more embodiments, the disclosure provides a marking module. In one embodiment, the marking module includes an energy storage unit, a power port, a wireless transceiver unit, and a processing unit. The energy storage unit stores electricity. The power port receives the electricity and charges the energy storage unit by the electricity. The wireless transceiver unit selectively generates a first wireless signal according to a control signal. The processing unit is electrically connected to the power port and the wireless transceiver unit and determines whether the power port receives the electricity, to generate the control signal.

BRIEF DESCRIPTION OF THE DRAWINGS

The present disclosure will become more fully understood from the detailed description given herein below for illustration only and thus does not limit the present disclosure, wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
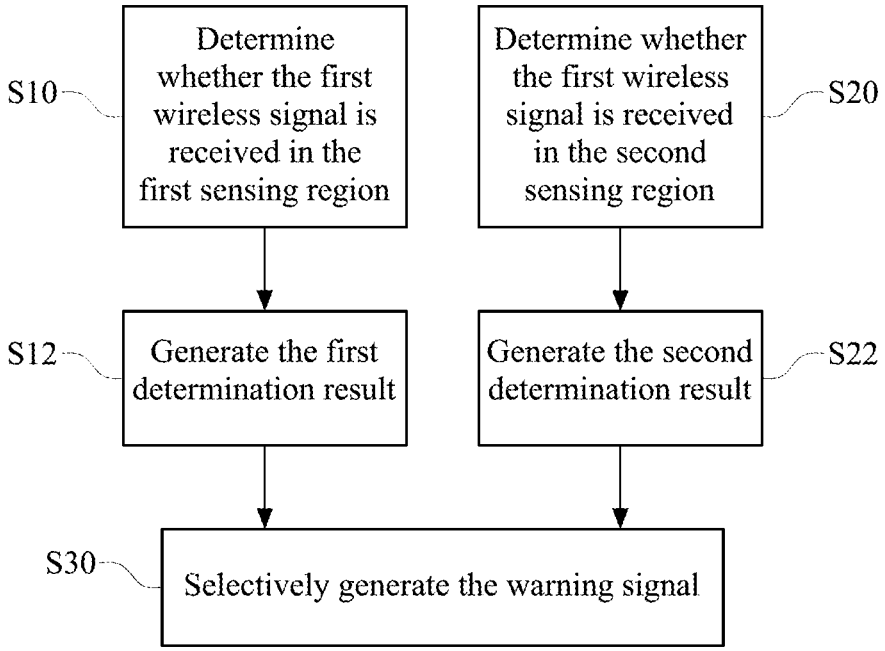
FIG. 1 is a flow chart of a surveillance method according to an embodiment of the disclosure.
Figure 2:
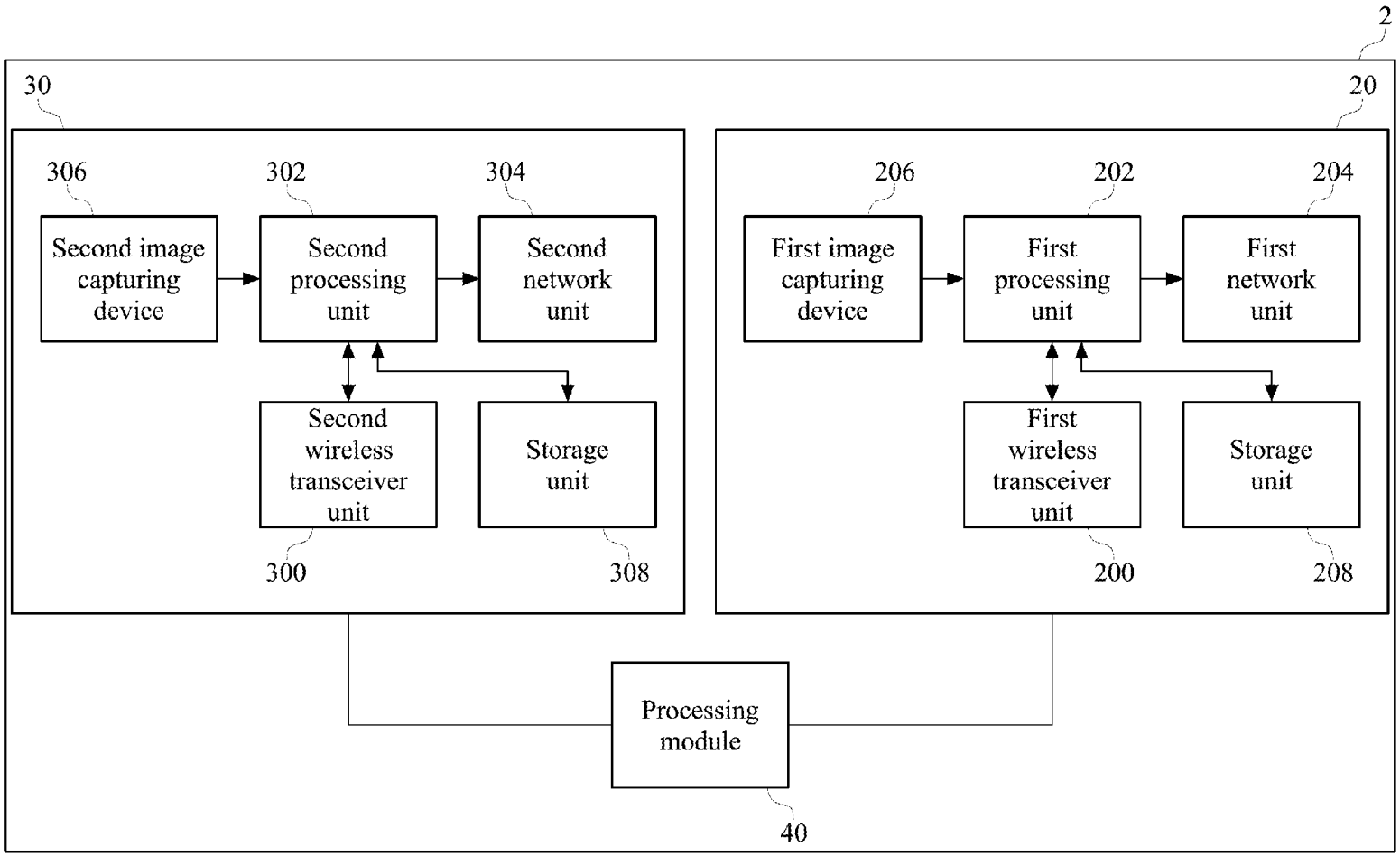
FIG. 2 is a block diagram of a surveillance apparatus according to an embodiment of the disclosure.

Referring to FIG. 1 and FIG. 2, the process of a surveillance apparatus and the operation of a surveillance apparatus are shown. FIG. 1 is a flow chart of a surveillance method according to an embodiment of the disclosure, and FIG. 2 is a block diagram of a surveillance apparatus according to an embodiment of the disclosure. The surveillance method and the surveillance apparatus are applied to an active burglarproof system to monitor a surveillance environment. A surveillance apparatus 2 in FIG. 2 includes, for example, a first sensing module 20, a second sensing module 30, and a processing module 40.

The first sensing module 20 includes, for example, a first wireless transceiver unit 200, a first processing unit 202, and a storage unit 208. The first wireless transceiver unit 200 receives a first wireless signal in a first sensing region of the surveillance environment, and the first wireless signal is related to a monitored object which a marking module is disposed on. The detail of the marking module will be described later. The first processing unit 202 is electrically connected to the first wireless transceiver unit 200 and determines whether the first wireless transceiver unit 200 receives the first wireless signal, whether the information of the first wireless signal is recorded in a surveillance list stored in the storage unit 208, and whether the first sensing region is a warning region, to generate a first determination result.

The second sensing module 30 includes, for instance, a second wireless transceiver unit 300, a second processing unit 302, and a storage unit 308. The second wireless transceiver unit 300 receives the first wireless signal in a second sensing region of the surveillance environment. The second processing unit 302 is electrically connected to the second wireless transceiver unit 300 and determines whether the second wireless transceiver unit 300 receives the first wireless signal, whether the information of the first wireless signal is recorded in a surveillance list stored in the storage unit 308, and whether the second sensing region is a warning region, to generate a second determination result.

The processing module 40 communicates with the first sensing module 20 and the second sensing module 30 to generate a warning signal and/or record the location of a monitored object according to the first determination result and the second determination result. For example, the data exchange between the processing module 40 and the sensing modules is carried out by a communication protocol.

The operation of the surveillance apparatus 2 is summarized in the following surveillance method shown in FIG. 1. In step S10, determine whether the first wireless signal is received in the first sensing region, to generate the first determination result in step S12. In step S20, determine whether the first wireless signal is received in the second sensing region, to generate the second determination result in step S22. In step S30, selectively generate the warning signal.

Figure 3:
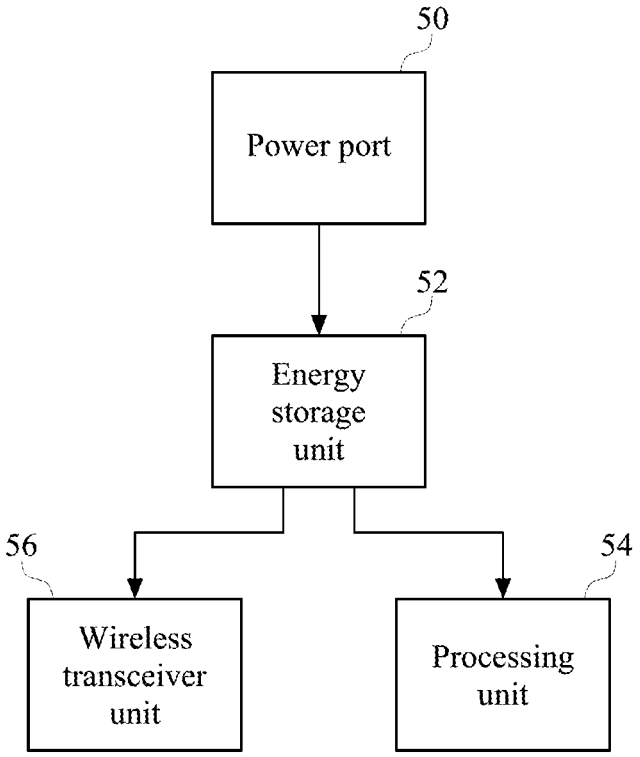
FIG. 3 is a block diagram of a marking module according to an embodiment of the disclosure.

FIG. 3 is a block diagram of a marking module according to an embodiment of the disclosure. A marking module 5 can be applied to a monitored object (e.g. an electric vehicle, bicycle or chart) and includes, for instance, a power port 50, an energy storage unit 52, a processing unit 54, and a wireless transceiver unit 56.

The power port 50 receives electricity and charges the energy storage unit 52 by the electricity. The processing unit 54 is electrically connected to the power port 50 and the wireless transceiver unit 56 and determines whether the power port 50 receives the electricity, to produce a control signal. The wireless transceiver unit 56 selectively produces a first wireless signal according to the control signal. For example, when the power port 50 disposed in an electric vehicle does not connect to an external power socket yet and the energy storage unit 52 needs to power the processing unit 54 and the wireless transceiver unit 56, because the processing unit 54 does not receive any electricity from the power port 50, the processing unit 54 generates a control signal to command the wireless transceiver unit 56 to output the first wireless signal.

The marking module 5 disposed on a monitored object in a surveillance environment is monitored by the active burglarproof system, and the detail of the surveillance environment is described below.

Figure 4:
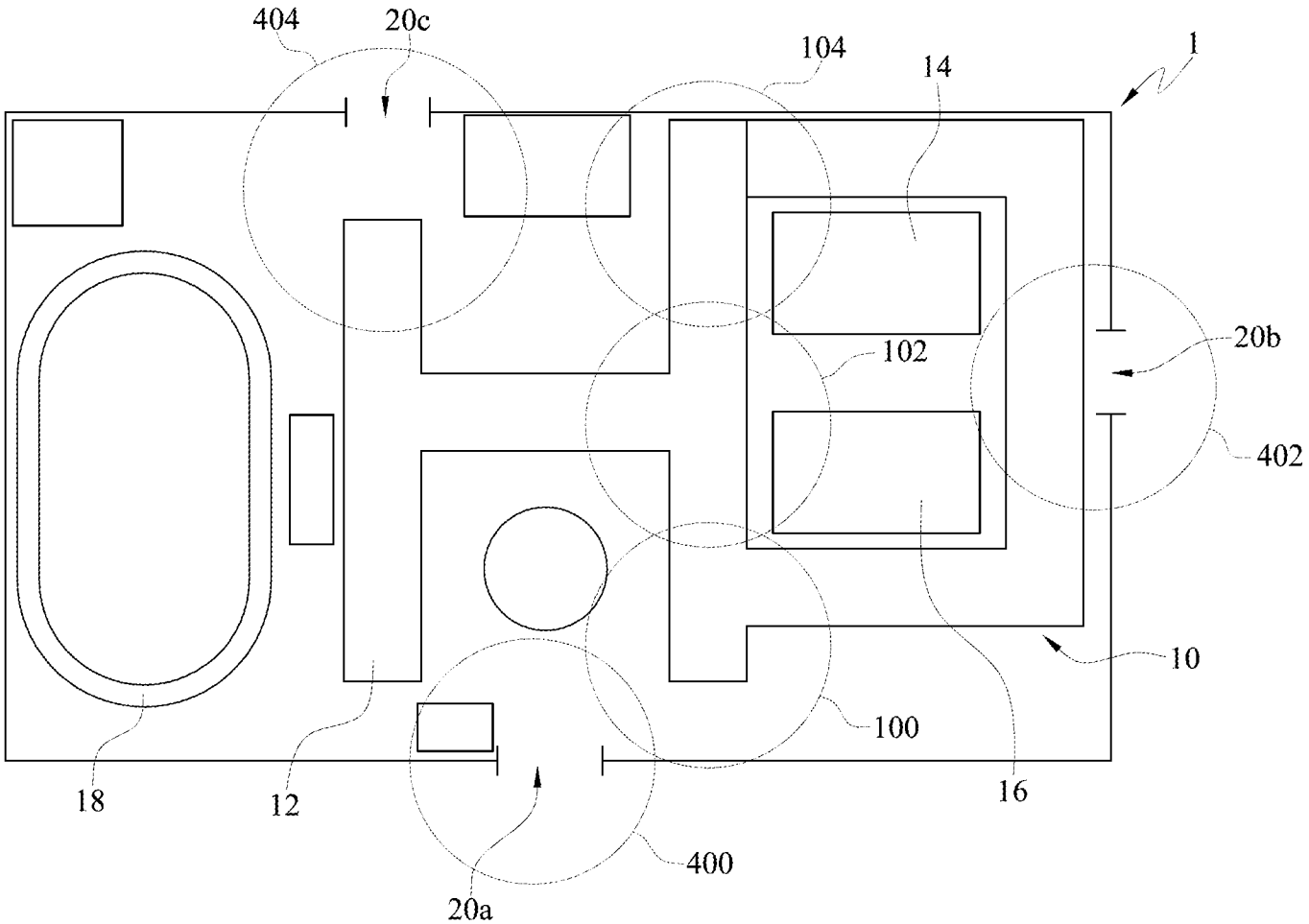
FIG. 4 is a schematic diagram of a surveillance environment according to an embodiment of the disclosure.

FIG. 4 is a schematic diagram of a surveillance environment according to an embodiment of the disclosure. One or more surveillance apparatuses can be used in a surveillance environment (e.g. a campus, park or market). To clearly describe the disclosure, the following exemplary description is based on a campus 1 in FIG. 4 as the surveillance environment. The campus 1 includes, for example, buildings 12, 14 and 16, a playground 18, and gates 20*a*, 20*b* and 20*c*, and sensing regions 100, 102, 104, 400, 402 and 404 are set in the campus 1. The sensing regions 100, 102 and 104 correspond to the building 12 and are normal areas for a marking module to move such that the sensing regions 100, 102 and 104 are non-warning regions. The sensing regions 400, 402 and 404 correspond to gates 20*a*, 20*b* and 20*c* and are abnormal areas for the marking module to move such that the sensing regions 400, 402 and 404 are warning regions.

The marking module can be disposed on, for example, an electric vehicle, a bicycle or a chart. Various exemplary embodiments of operational states of the marking module existing in the surveillance environment in FIG. 4 are described below.

Figure 5:
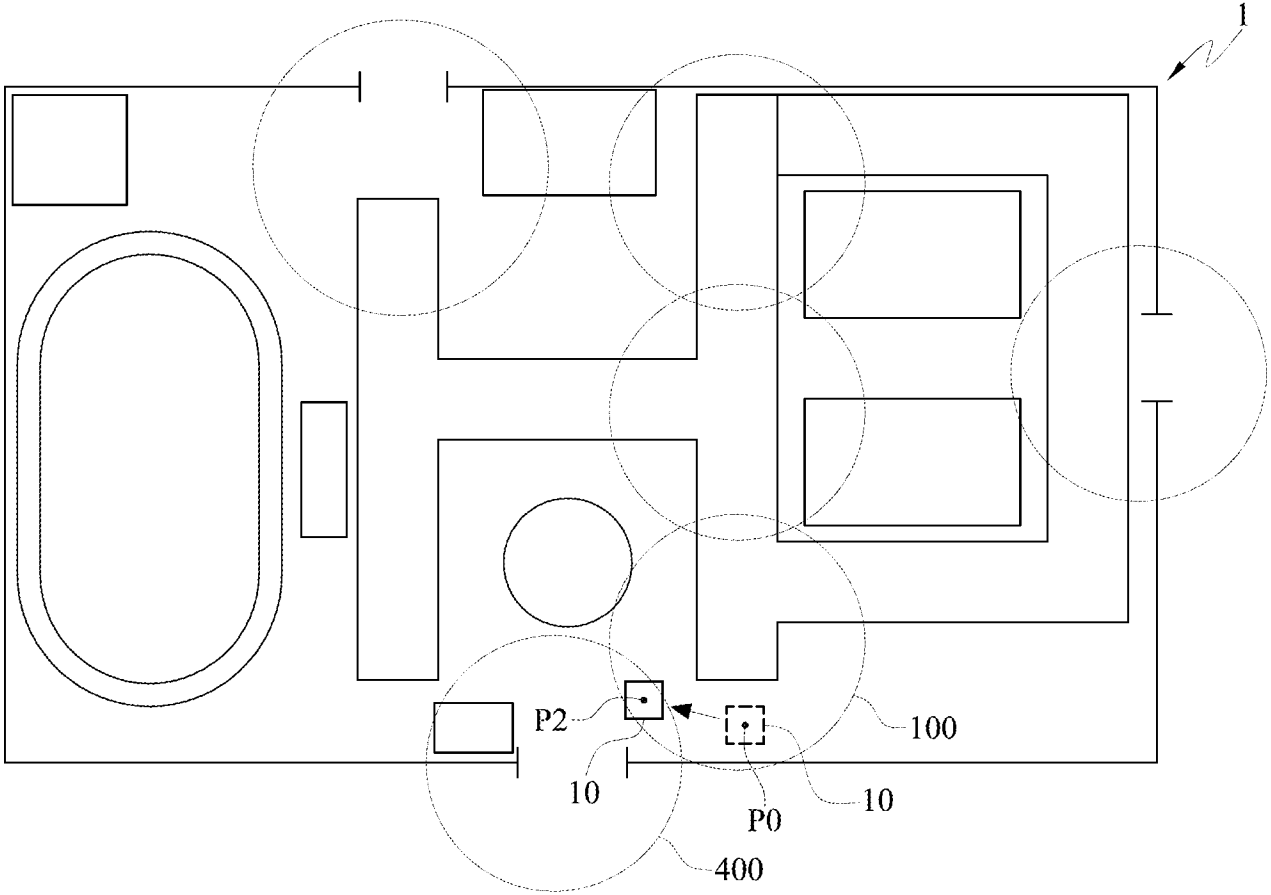
FIG. 5 is a schematic diagram of a surveillance environment where a marking module exists according to an embodiment of the disclosure.

FIG. 5 is a schematic diagram of a surveillance environment where a marking module exists according to an embodiment of the disclosure. When a marking module 10 as a monitored object exists in the campus 1 in FIG. 4, the active burglarproof system will monitor the marking module 10 by the surveillance apparatus 2 in FIG. 2. Specifically, the first processing unit 202 determines whether the first wireless transceiver unit 200 in the first sensing region 100 of the campus 1 receives a first wireless signal, to generate a first determination result. Also, the second processing unit 302 determines whether the second wireless transceiver unit 300 in the second sensing region 400 of the campus 1 receives the first wireless signal, to generate a second determination result. When the first and second determination results indicate that the first wireless signal is received by the first wireless transceiver unit 200 rather than the second wireless transceiver unit 300, the processing module 40 will not generate any warning signal according to the first determination result and will record the location P0 of the marking module 10 in the campus 1. The marking module 10 can be referred to the marking module 5 in FIG. 3 and will not be repeated hereinafter.

The detailed surveillance method of monitoring the marking module 10 in the campus 1 by the surveillance apparatus 2 is described below.

Figure 6:
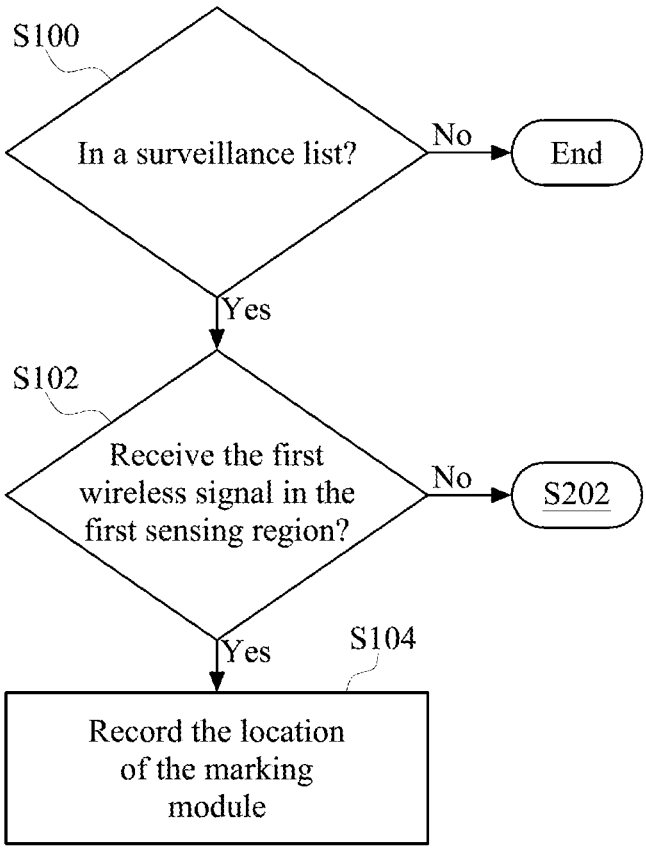
FIGS. 6, 7 and 9 illustrates a flow chat of a surveillance method according to an embodiment of the disclosure.
Figure 7:
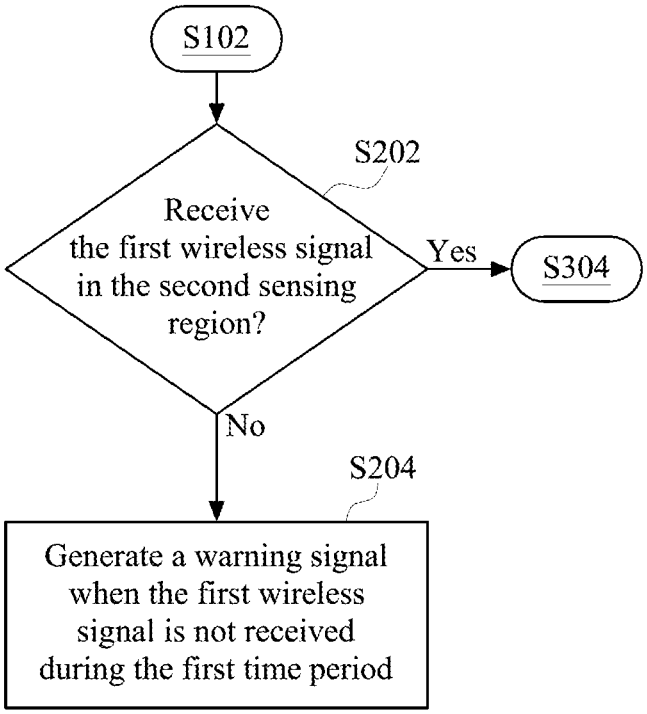
Figure 9:
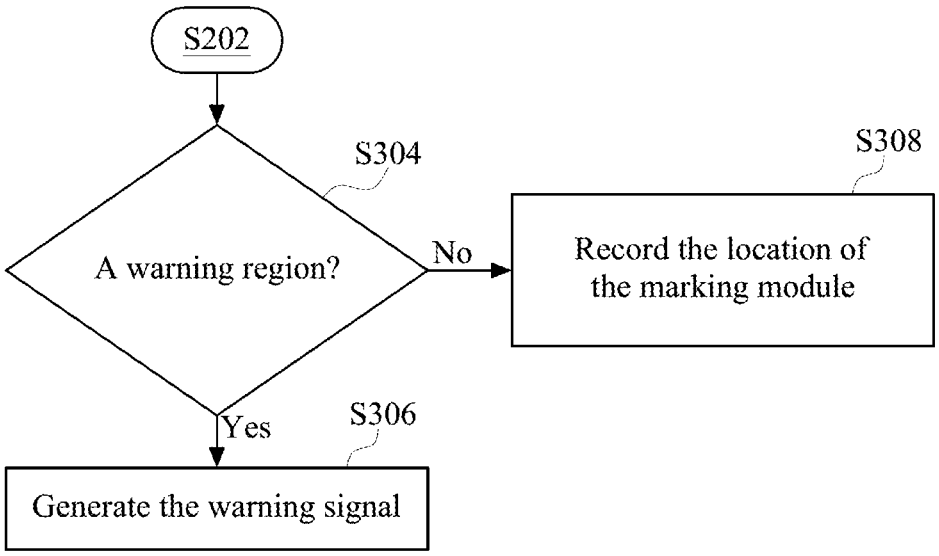

FIGS. 6, 7 and 9 illustrates a flow chat of a surveillance method according to an embodiment of the disclosure. In step S100, after the first wireless transceiver unit 200 receives the first wireless signal, the first processing unit 202, according to the first wireless signal, determines whether the marking module 10 is recorded in a surveillance list, to produce a third determination result. The first wireless signal is related to the marking module 10. When the third determination result indicates that the marking module 10 is recorded in the surveillance list. In step S102, the first processing unit 202 determines whether the first wireless transceiver unit 200 receives the first wireless signal in the first sensing region 100, to generate the first determination result. In step S104, when the first determination result indicates that the first wireless signal is received in the first sensing region 100, the first processing unit 202 records the location of the marking module 10. When the third determination result indicates that the marking module 10 is not recorded in the surveillance list, the process ends.

In an exemplary embodiment, the marking module 10 disposed on an electric vehicle exists in the first sensing region 100 of the campus 1 as shown in FIG. 5. The first sensing region 100 corresponds to a surveillance apparatus, but the disclosure will not be limited thereto. When the first processing unit 202, according to the first wireless signal, determines that marking module 10 is recorded in the surveillance list, the electric vehicle can be considered as a monitored object. The surveillance list is stored in a first storage unit 208. For example, the first wireless signal carries an alphabetic string related to the marking module 10. After the first wireless transceiver unit 200 receives the first wireless signal from the marking module 10, the first processing unit 202 checks whether the surveillance list has an alphabetic string matching the alphabetic string of the first wireless signal. When the surveillance list has such an alphabetic string, the third determination result indicates that the marking module 10 is recorded in the surveillance list and can be considered as a monitored object. The determination of the marking module 10 can be any possible way in the art.

In another exemplary embodiment, the marking module 10 disposed on an electric vehicle exists in not only the first sensing region 100 but also the second sensing region 400 in the campus 1 as shown in FIG. 5. Each sensing region corresponds to one surveillance apparatus, but the disclosure will not be limited thereto. When the marking module 10 is considered as a monitored object and when the first processing unit 202 determines that the first wireless transceiver unit 200 receives the first wireless signal in the first sensing region 100 and the second processing unit 302 determines that the second wireless transceiver unit 300 does not receive the first wireless signal in the second sensing region 400, the processing module 40 does not generate any warning signal according to the first determination result produced by the first processing unit 202 and the second determination result produced by the second processing unit 302, and records the location P0 of the marking module 10.

In an exemplary embodiment, after the location P0 of the marking module is recorded, the marking module 10 produces the first wireless signal. When the first determination result of the first processing unit 202 and the second determination result of the second processing unit 302 indicate that the first wireless signal from the marking module 10 is received in the first sensing region 100 and the second sensing region 400 both, the first processing unit 202 and/or the second processing unit 302 records the location P2 of the marking module 10. In this way, the processing module 40 does not generate any warning signal and records the moving path of the marking module 10. For example, when the marking module 10 disposed on an electric vehicle is considered as a monitored object, the marking module 10 outputs the first wireless signal every second time period, e.g. every 3 minutes. In the interval time period, the processing module 40 records the moving path of the marking module 10 according to various locations of the marking module 10.

Subsequently, in FIG. 7, the process of the surveillance method progresses to step S202 when the first determination result indicates that the first wireless signal is not received in the first sensing region 100 in step S102. In step S202, determine whether the first wireless signal is received in the second sensing region 400, to produce a second determination result. When the second determination result indicates that the first wireless signal is not received in the second sensing region 400, a warning signal is selectively generated according to the first and second determination results during the first time period in step S204.

Figure 8:
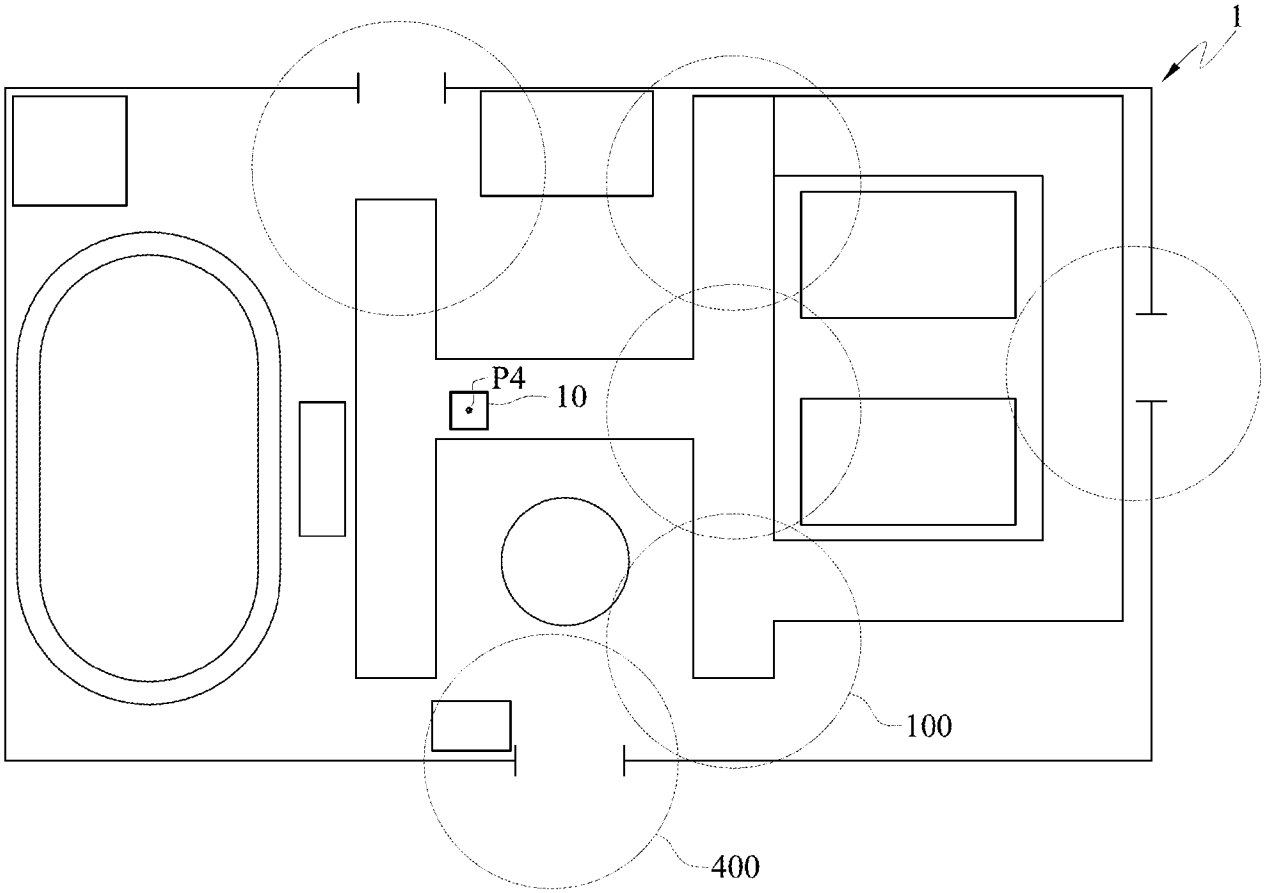
FIG. 8 is a schematic diagram of a surveillance environment where a marking module exists according to an embodiment of the disclosure.

To clearly describe the steps S102, S202 and S204, the following exemplary embodiment is based on the surveillance environment in FIG. 4. FIG. 8 is a schematic diagram of a surveillance environment where the marking module exists according to an embodiment of the disclosure. The marking module 10 disposed on an electric vehicle exists at the location P4 in the campus 1 shown in FIG. 8. The first and determination results indicate that no first wireless signal is received. When no first wireless signal has been received in the first sensing region 100 and the second sensing region 400 for a first time period, a warning signal will be produced according to the first determination result and the second determination result.

For example, when an electric vehicle is considered as a monitored object, the marking module 10 generates and outputs a first wireless signal every second time period, e.g. 3 seconds. When the first wireless signal has not been received by the first wireless transceiver unit 200 in the first sensing region 100 and the second wireless transceiver unit 300 in the second sensing region 400 for a first time period (e.g. 3.5 seconds), a warning signal will be produced. The warning signal can be, for instance, sounds played by an audio player, or light emitted by a light emitter. In this way, the disclosure can support an active warning function.

Following step S202, the process of the surveillance method progresses to step S304 in FIG. 9. When the information carried by the first wireless signal is recorded in the surveillance list and when the first wireless signal is received in the second sensing region 400 rather than the first sensing region 100, whether the second sensing region 400 is a warning region is determined in S304. When the second sensing region 400 is a warning region, a warning signal is produced in step S306. When the second sensing region 400 is not a warning region, the location of the marking module 10 is recorded in step S308.

Figure 10:
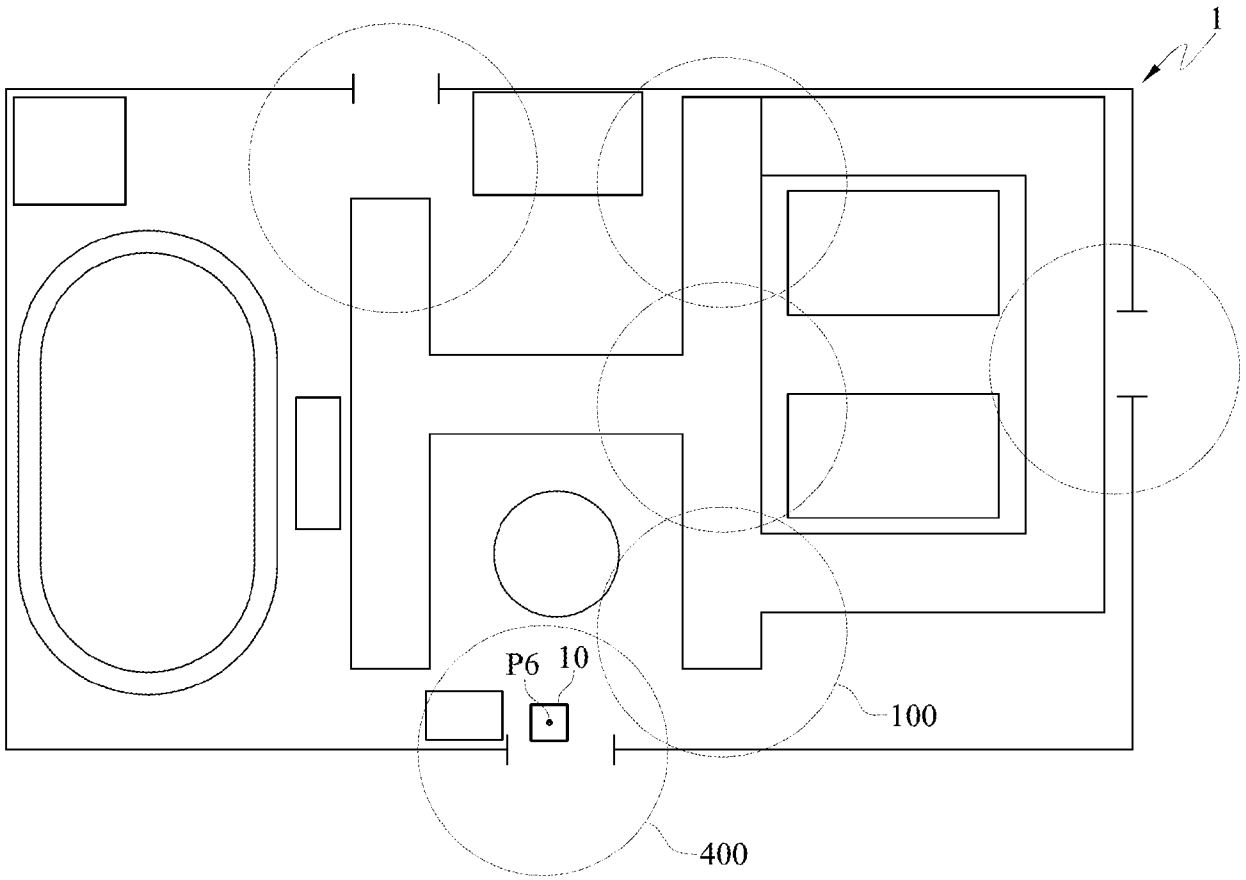
FIG. 10 is a schematic diagram of a surveillance environment where a marking module exists according to an embodiment of the disclosure.

FIG. 10 is a schematic diagram of a surveillance environment where a marking module in FIG. 3 exists according to an embodiment of the disclosure. In the campus 1, a marking module 10 disposed on an electric vehicle as a monitored object is at location P6 near the gates 20*a*. After receiving the first wireless signal in the second sensing region 400, the second processing unit 202 determines that the second sensing region 400 is a warning region, and then the processing module 40 produces a warning signal.

Figure 11:
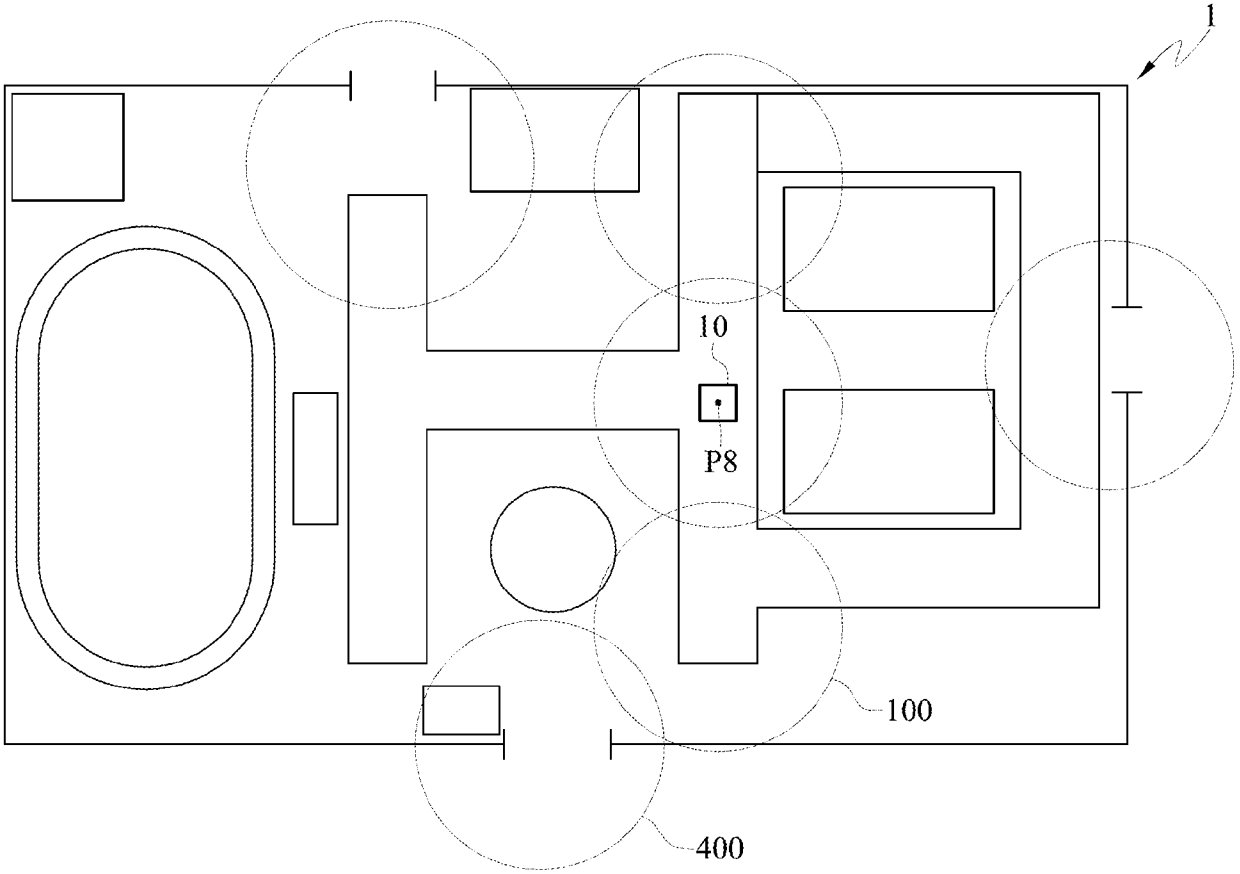
FIG. 11 is a schematic diagram of a surveillance environment where a marking module exists according to an embodiment of the disclosure.

FIG. 11 is a schematic diagram of a surveillance environment where a marking module in FIG. 3 exists according to an embodiment of the disclosure. In the campus 1 shown in FIG. 4, a marking module 10 disposed on an electric vehicle as a monitored object is at location P8. After receiving the first wireless signal in the second sensing region 400, when the second sensing region 400 is not a warning region, the location P8 of the marking module 10 is recorded.

The above embodiments of surveillance method are summarized in Table 1, where the information of the first wireless signal is recorded in the surveillance list, the first determination result (referred to as $1^{st}$ result) indicates whether the first wireless signal is received in the first sensing region 100, the second determination result (referred to as $2^{nd}$ result) indicates whether the first wireless signal is received in the second sensing region 400, and a fourth determination result (referred to as $4^{th}$ result) indicates whether the second sensing region 400 is a warning region.

TABLE 1

| $1^{st}$ result | $2^{nd}$ result | $4^{th}$ result | Corresponding Action |
|---|---|---|---|
| Y | N | / | Record the location of the marking module |
| Y | Y | N | Record the location of the marking module |
| Y | Y | Y | Record the location of the marking module |
| N | N | / | Generate warning signal |
| N | Y | Y | Generate warning signal |
| N | Y | N | Record the location of the marking module |

In the disclosure, the processing module 40 in FIG. 2 can further include multiple display units respectively corresponding to the first sensing region 100 and the second sensing region 400. When the warning signal is selectively generated according to the first and second determination results, the warning signal can be displayed by these display units in order to actively warn users.

In the disclosure, the first sensing module 20 can further include a first network unit 204, and the second sensing module 30 can further include a second network unit 304. For example, when the first processing unit 202 generates a first determination signal according to the first determination result, the first network unit 204 can transmit the first determination signal to a user end through a local area network (LAN).

In the disclosure, the first sensing module 20 can further include a first image capturing device 206 to capture images or videos for the recording of the location of the marking module 10, and the second sensing module 30 can further include a second image capturing device 306 to capture images or videos for the recording of the location of the marking module 10.

As set forth above, the surveillance method and the surveillance apparatus can be applied to an active burglarproof system. The surveillance apparatus performs the surveillance method to employ the first processing unit and the second processing unit to determine whether the first wireless signal is recorded in a surveillance list, in order to determine whether the marking module related to the first wireless signal is a monitored object in the surveillance list. The disclosure also records the moving path of the marking module by the locations of the marking module. The disclosure further supports an early-warning function to actively output a warning signal when a monitored object exits in a warning region.

What is claimed is:

1. A surveillance method applied to an active burglarproof system, comprising:

determining, by a marking module, whether a power port of the marking module receives power, to generate a first wireless signal;

determining whether the first wireless signal generated from the marking module is received in a first sensing region, to produce a first determination result;

determining whether the first wireless signal is received in a second sensing region, to produce a second determination result; and selectively generating a warning signal according to the first determination result and the second determination result.

2. An active burglarproof system, comprising:

a marking module comprising:

an energy storage unit configured to store electricity;

a power port configured to receive power and charge the energy storage unit;

a processing unit electrically connected to the power port and the energy storage unit and configured to determine whether the power port receives the power, to generate a control signal; and a wireless transceiver unit connected to the processing unit and configured to selectively generate a first wireless signal according to the control signal;

a first sensing module comprising:

a first wireless transceiver unit configured to, in a first sensing region, receive the first wireless signal generated from the marking module; and a first processing unit electrically connected to the first wireless transceiver unit and configured to determine whether the first wireless transceiver unit receives the first wireless signal, to selectively produce a first determination result;

a second sensing module comprising:

a second wireless transceiver unit configured to, in a second sensing region, receive the first wireless signal; and a second processing unit electrically connected to the second wireless transceiver unit and configured to determine whether the second wireless transceiver unit receives the first wireless signal, to selectively generate a second determination result; and a processing module configured to communicate with the first sensing module and the second sensing module and selectively generate a warning signal according to the first determination result and the second determination result.

3. The surveillance method according to claim 2, further comprising:

not generating the warning signal and recording a location of the marking module when the third determination result indicates that the marking module is recorded in the surveillance list and when the first and second determination results indicate that the first wireless signal is received in the first sensing region rather than the second sensing region.

4. The surveillance method according to claim 2, further comprising:

not generating the warning signal and recording a location of the marking module when the third determination result indicates that the marking module is recorded in the surveillance list and when the first and second determination results indicate that the first wireless signal is received in the first sensing region and the second sensing region both.

5. The surveillance method according to claim 1, further comprising:

when the second determination result indicates that the first wireless signal is received in the second sensing region, determining whether the second sensing region is a warning region; and when the second sensing region is the warning region, generating the warning signal.

6. The surveillance method according to claim 5, wherein when the second sensing region is not the warning region, the warning signal is not generated and a location of the marking module is recorded.

7. The surveillance method according to claim 1, wherein the step of selectively generating the warning signal according to the first determination result and the second determination result comprises:

generating the warning signal when the first wireless signal is not received in the first sensing region and the second sensing region during a first time period yet.

8. A surveillance apparatus applied to an active burglarproof system, comprising:

a first sensing module comprising:

a first wireless transceiver unit configured to, in a first sensing region, receive a first wireless signal related to a marking module; and a first processing unit electrically connected to the first wireless transceiver unit and configured to determine whether the first wireless transceiver unit receives the first wireless signal, to selectively produce a first determination result;

a second sensing module comprising:

a second wireless transceiver unit configured to, in a second sensing region, receive the first wireless signal; and a second processing unit electrically connected to the second wireless transceiver unit and configured to determine whether the second wireless transceiver unit receives the first wireless signal, to selectively generate a second determination result; and a processing module configured to communicate with the first sensing module and the second sensing module and selectively generate a warning signal according to the first determination result and the second determination result.

9. The surveillance apparatus according to claim 8, wherein each of the first and second sensing modules further comprises a storage unit configured to store a surveillance list, and the first processing unit and the second processing unit further determine whether the marking module is recorded in the surveillance list, to generate a third determination result.

10. The surveillance apparatus according to claim 9, wherein when the first processing unit indicates that the marking module is recorded in the surveillance list and when the first processing unit determines that the first wireless signal is received in the first sensing region of the first wireless transceiver unit according to the first determination result and the second processing unit determines that the first wireless signal is not received in the second sensing region of the second wireless transceiver unit according to the second determination result, the processing module does not generate the warning signal and records a location of the marking module.

11. The surveillance apparatus according to claim 9, wherein, when the third determination result indicates that the marking module is recorded in the surveillance list and when the first processing unit determines that the first wireless signal is received in the first sensing region of the first wireless transceiver unit according to the first determination result and the second processing unit determines that the first wireless signal is received in the second sensing region of the second wireless transceiver unit according to the second determination result, the processing module does not generate the warning signal and records a location of the marking module.

12. The surveillance apparatus according to claim 8, wherein the second processing unit further determines whether the second sensing region is a warning region, and when the second sensing region is the warning region, the warning signal is generated.

13. The surveillance apparatus according to claim 12, wherein, when the second sensing region is not the warning region, the warning signal is not generated and a location of the marking module is recorded.

14. The surveillance apparatus according to claim 8, wherein, when the first wireless signal is received in neither the first sensing region of the first wireless transceiver unit nor the second sensing region of the second wireless transceiver unit during a first time period, the warning signal is generated.

15. The active burglarproof system according to claim 8, wherein the wireless transceiver unit generates the first wireless signal every a second time period.

16. The active burglarproof system according to claim 15, wherein the first wireless signal is an alphabetic string that is related to the marking module and used for identifying the marking module.

* * * * *